US006701696B1

(12) United States Patent
Torre

(10) Patent No.: US 6,701,696 B1
(45) Date of Patent: Mar. 9, 2004

(54) PACKAGING MACHINE OF THE TUNNEL TYPE FOR CARRYING OUT PACKAGING WITH A HEAT-SHRINKABLE FILM

(75) Inventor: Francesco Torre, Dalmine (IT)

(73) Assignee: Minipack-Torre S.p.A. (IT)

( * ) Notice: Subject to any disclaimer, the term of this patent is extended or adjusted under 35 U.S.C. 154(b) by 0 days.

(21) Appl. No.: 09/546,375

(22) Filed: Apr. 10, 2000

(30) Foreign Application Priority Data

Apr. 15, 1999 (IT) ..... MI990219 U

(51) Int. Cl.[7] ..... B65B 53/02
(52) U.S. Cl. ..... 53/557; 53/442; 53/568
(58) Field of Search ..... 53/557, 568, 374.9, 53/442

(56) References Cited

U.S. PATENT DOCUMENTS 3,584,435 A * 6/1971 Grasvoll et al. ..... 53/557
3,653,177 A * 4/1972 Adams et al. ..... 53/550
3,678,244 A * 7/1972 Worline ..... 219/388
3,869,844 A * 3/1975 Edouard ..... 53/442
4,162,604 A * 7/1979 Bartolomei ..... 53/557
4,574,565 A * 3/1986 Gambetti ..... 53/442
5,044,142 A * 9/1991 Gianelli ..... 53/434
5,179,819 A * 1/1993 Sukeyasu et al. ..... 53/442
5,299,406 A * 4/1994 Laury ..... 53/397
5,339,605 A * 8/1994 Simpson et al. ..... 53/439
5,381,644 A * 1/1995 Di Bernardo ..... 53/557
5,400,570 A * 3/1995 Bennett ..... 53/442
5,519,983 A * 5/1996 Moen ..... 53/442
5,546,677 A * 8/1996 Tolson ..... 34/216
5,746,041 A * 5/1998 Tolson ..... 53/442
5,797,247 A * 8/1998 Nakagoshi et al. ..... 53/442
5,799,281 A * 8/1998 Login et al. ..... 705/1
5,826,411 A * 10/1998 Butturini ..... 53/557
5,899,048 A * 5/1999 Havens et al. ..... 53/442
6,151,871 A * 11/2000 Torre ..... 53/557
6,158,199 A * 12/2000 Emery et al. ..... 53/442
6,491,166 B1 * 12/2002 Compton et al. ..... 206/497

* cited by examiner

*Primary Examiner*—Rinaldi I. Rada
*Assistant Examiner*—Gloria Weeks
(74) *Attorney, Agent, or Firm*—Shlesinger, Fitzsimmons & Shlesinger

(57) ABSTRACT

A packaging machine using a heat-shrinkable film comprises a frame (14, 16) for peripheral sealing of a film (19) segment and a tunnel (21) disposed alongside the frame, in which means (27) for air circulation is arranged, which air is heated by electrical heating elements (28) for shrinkage of the sealed film which is introduced into the tunnel. The machine comprises means (34) for detecting a condition associable with the presence in the machine of a product wrapped in a film to be shrunk. This detecting means (34) upon detection of said condition produces a signal (33) for temporary actuation of the hot-air circulation means (27).

12 Claims, 2 Drawing Sheets

PACKAGING MACHINE OF THE TUNNEL TYPE FOR CARRYING OUT PACKAGING WITH A HEAT-SHRINKABLE FILM

BACKGROUND OF THE INVENTION

The present invention relates to an improvement in a packaging machine using a heat-shrinkable film and provided with a shrinkage tunnel.

In the known art packaging machines using heat-shrinkable films are known and they comprise a frame for sealing of the film surrounding the product to be packaged and a shrinkage tunnel providing circulation of hot air in a continuous cycle.

A conveyor belt carries out passage through the tunnel of the products wrapped in the film already sealed by means of the frame. The film grazed by the hot air circulating within the tunnel shrinks on the product thereby packaging it.

In these shrinkage tunnels, air circulation through the electrical heating elements takes place in a continuous manner and temperature adjustment is carried out by a probe measuring the air temperature and sending a signal to an appropriate thermoregulator adjusting the heating power of the electrical heating elements.

This way of operating involves a high energy consumption and a high thermal pollution in the work environment due to continuous emission of hot air. On the other hand, if air heating is reduced, film shrinkage becomes unsatisfactory. It is a general aim of the present invention to obviate the above mentioned drawbacks by providing a packaging machine of the above type, which allows high energy saving while keeping a satisfactory heat-shrinkage of the film.

SUMMARY OF THE INVENTION

In view of the above aim, in accordance with the invention a packaging machine using a heat-shrinkable film has been devised which comprises a frame for peripheral sealing of a film segment and a tunnel disposed alongside the frame in which means is arranged for circulation of the air heated by electrical heating elements for shrinkage of the sealed film which is introduced into the tunnel, characterised in that it comprises means for detecting a condition associable with the presence in the machine of a product wrapped in a film to be shrunk, the detecting means, upon detection of said condition, producing a signal for temporary actuation of the hot-air circulation means.

BRIEF DESCRIPTION OF THE DRAWINGS

For better explaining the innovatory principles of the present invention and the advantages it offers over the known art, a possible embodiment applying said principles will be described hereinafter, by way of non-limiting example, with the aid of the accompanying drawings. In the drawings.

DETAILED DESCRIPTION OF THE INVENTION

Figure 1:
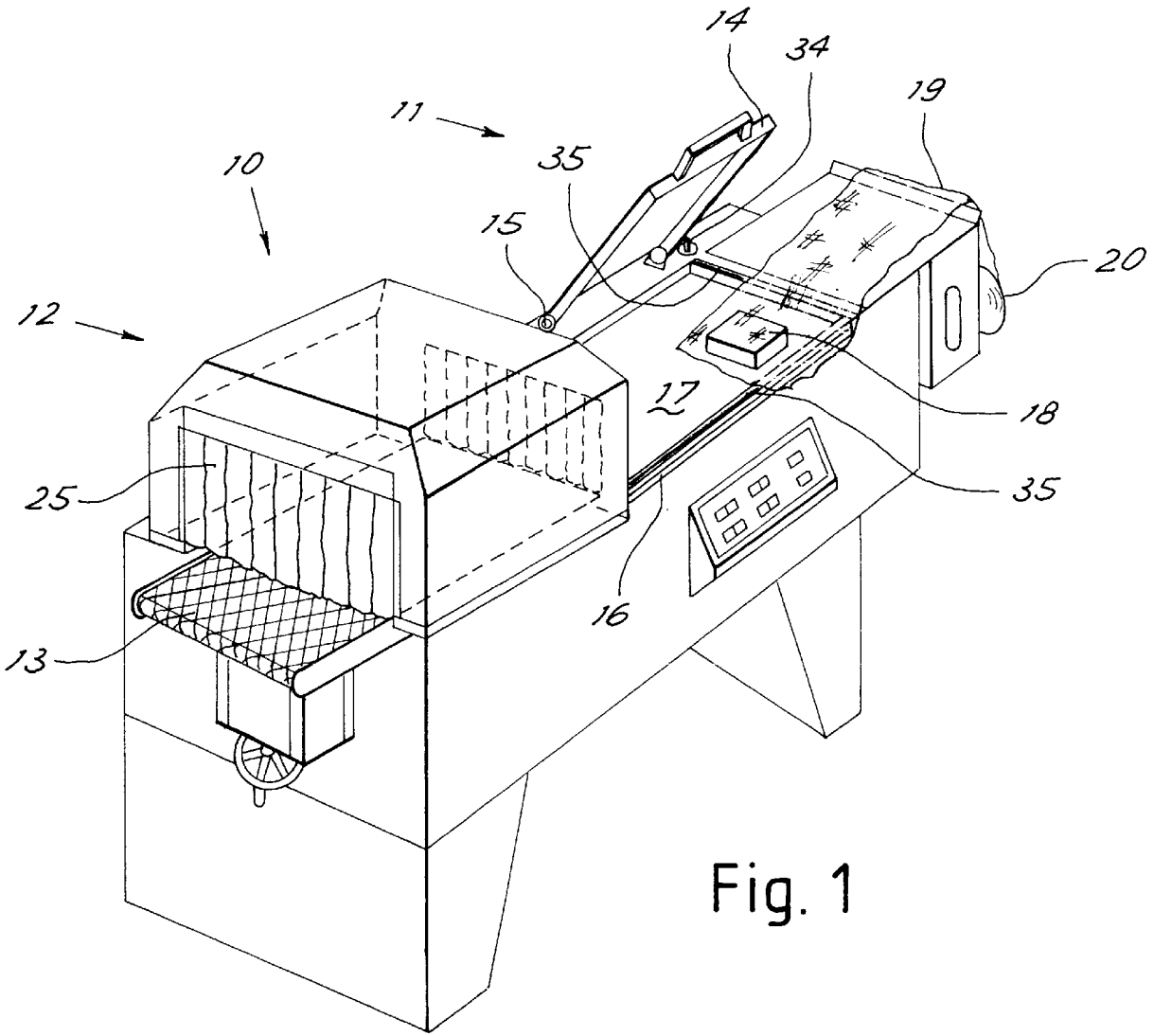
FIG. 1 is a diagrammatic perspective view of a packaging machine embodied by the invention.

With reference to the drawings, a packaging machine generally identified by 10 comprises a sealing region 11 and a heat-shrinkage region 12, connected with each other by a conveyor belt 13 made up of a perforated netting. The sealing region comprises a frame 14 hinged at 15, to be moved close to a fixed counter-frame or abutment 16 provided with sealing blades 35 at the upper part thereof. Frame 14 surrounds a support table 17 along three sides thereof, on which table the products or items 18 to be packaged by means of a heat-shrinkage film 19 unwound from a supply bobbin 20 are disposed. The film is longitudinally folded to surround the product at the upper and lower parts thereof and the open sides of the film are sealed by the action of the sealing blades 16 disposed on the front side and the upstream side (relative to the film feeding direction) of table 17.

Figure 3:
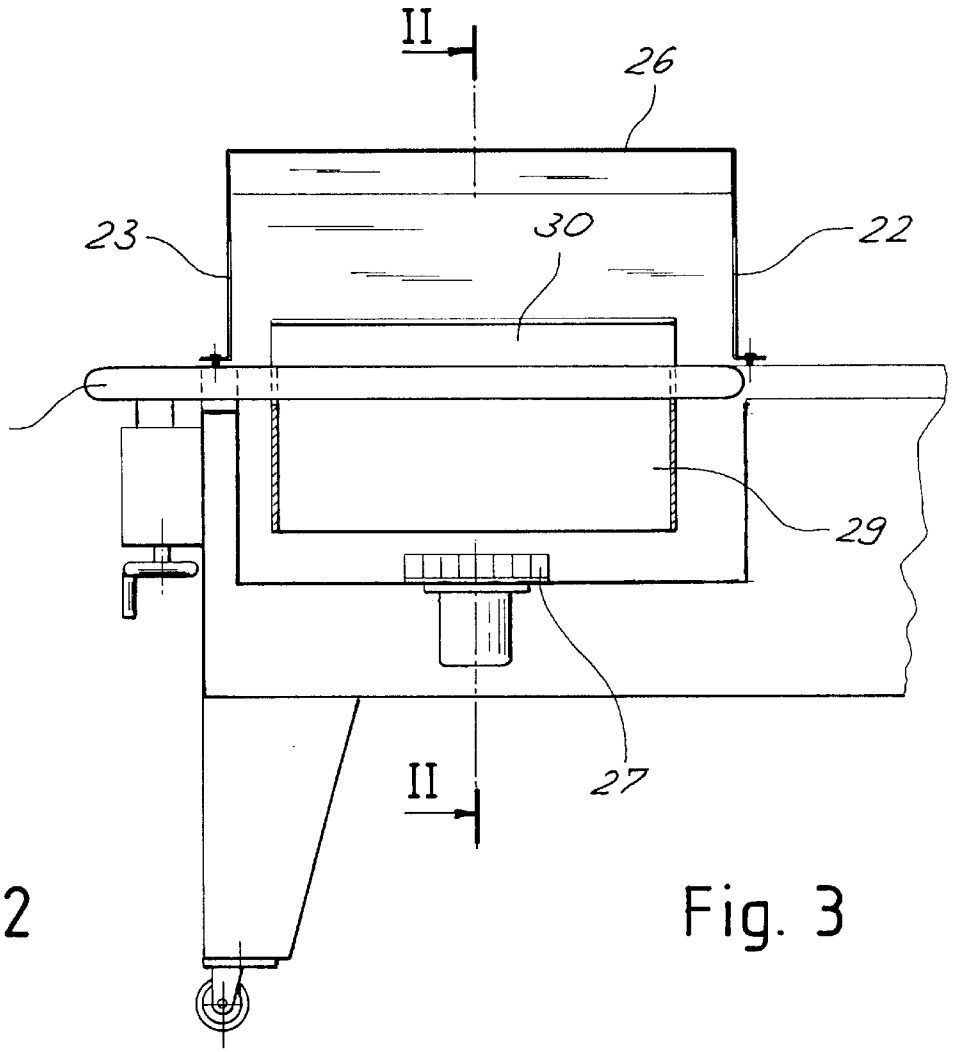
FIG. 3 is a view partly in longitudinal section of the machine in FIG. 1, taken along line III—III in FIG. 2.
Figure 2:
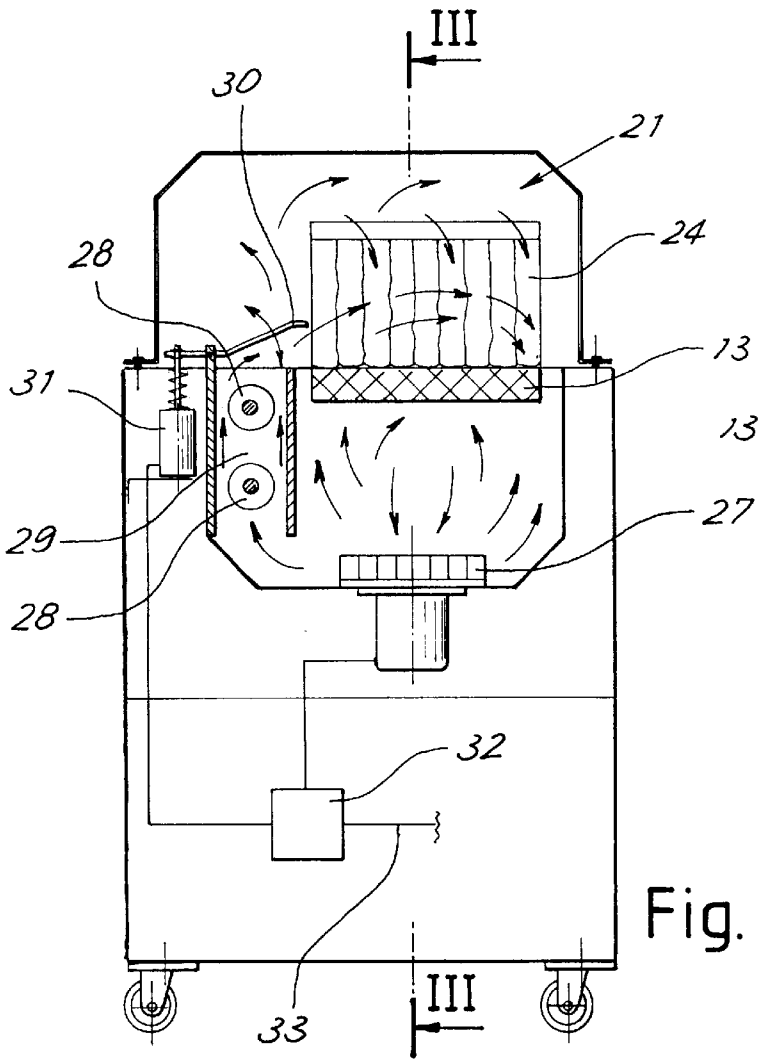
FIG. 2 is a cross-sectional view of the machine in FIG. 1, taken along line II—II in FIG. 3; FIG.

As also clearly shown in FIGS. 2 and 3, the shrinkage region comprises a hot-air shrinkage chamber or tunnel 21 in which a rest surface is present which consists of the upper part of the conveyor belt 13 passing through the chamber to convey the items wrapped in the film between an entry opening 22 and an exit opening 23. The two openings are advantageously closed by depending flexible bands 24, 25 enabling passage of the items while reducing dispersion of hot air to the outside of the chamber.

The chamber is defined at the upper part thereof by a cover or vault 26 advantageously made at least partly of a transparent material, so as to enable sight of the shrinkage process taking place inside it.

In the shrinkage chamber there is a fan 27 causing circulation of air within the chamber itself, making it pass through heat-adjusted electrical heating elements 28. Advantageously, the heating elements 28 are held in a baghouse 29 communicating at the lower and upper parts thereof with the shrinkage chamber. The upper opening of baghouse 29 is closed by a shutter or flap 30 driven for opening by an actuator 31 (an electromagnet, for example). Fan 27 and actuator 31 are operated by a control box or timer 32 receiving an enable signal 33 to operation by a control means 34. The control means 34 is operated for signalling that an item to be packaged is about to be or has been inserted into the shrinkage chamber. In other words, there is the presence of means 34 for detecting a condition associable with the presence in the machine of a product wrapped in a film to be shrunk; the detecting means, on detection of said condition, produces a signal 33 for temporary actuation of the means 27 for hot-air circulation.

In accordance with the described embodiment, the control means is embodied by a sensor or microswitch 34 detecting closure and subsequent re-opening of the sealing frame 14. This microswitch can be the same element switching on the synchronised-pulse heating of the sealing blades present in the frame. Since closure of the frame enables the sealing operation preceding the shrinkage operation to be carried out, the signal emitted by microswitch 34 is of relevance for starting a timely hot-air circulation in the tunnel. The control box or timer 32 will keep fan 27 and actuator 31 in operation over a predetermined period of time sufficient to achieve shrinkage of the film on the product.

This time may comprise the estimated time for introduction of the product into the tunnel and passage of the product therethrough until reaching of the tunnel exit. This time can be adjusted depending on requirements. By virtue of the transparency of tunnel 26 the shrinkage process can be watched while it is being carried out and the exactness of the set time can be checked with the possibility of adjusting it, if necessary.

In use, on starting of the packaging machine the net-type conveyor belt 13 is set in motion. Simultaneously, the thermostat-controlled electrical heating elements 28 within the heat baghouse 29 get hot until they reach the optimal temperature for heating of the air circulating within the tunnel.

By operating the sealing frame downwardly, sensor 34 enables heating of the sealing blades 26 for carrying out sealing of the film onto the item. When sealing has been completed, by lifting the frame to its rest position sensor 34 drives the control box 32 to start operation of the circulation fan and to open the heat baghouse. Meanwhile, the item can be introduced into the tunnel by means of the conveyor, so that at the tunnel exit 23 it appears conveniently packaged in the film shrunk thereon.

At this point it is apparent that the intended purposes have been achieved by supplying a packaging machine provided with a shrinkage tunnel in which the hot air circulation is not continuous, as it happened in the known art, but is only present when required for packaging of a product introduced into the tunnel itself, which will bring about a very important energy saving and a reduced environmental impact.

Obviously, the above description of an embodiment applying the innovatory principles of the present invention is given by way of example only and therefore must not be considered as a limitation of the scope of the invention as herein claimed.

For instance, the air-circulation fan can be also positioned at the tunnel top instead of being provided at the bottom. In addition, the sensor for starting the hot-air circulation can be also made in a different manner from the preferred embodiment shown. For instance, placement of a sensor provided with a photoelectric barrier may be envisaged at the entry opening of the tunnel for detecting passage of the product disposed on the belt. The sealing frame can be made in different ways: for example, the sealing blades may be fitted in the movable portion of the frame, instead of being arranged in the fixed one. The blades themselves may be accomplished both by pulsed heating and hot wire heating.

What is claimed is:

1. A packaging machine using a heat-shrinkable film, comprising sealing means including heatable sealing blades, and a frame movable in a first section of the machine from a rest position to a sealing position for effecting peripheral sealing of a segment of said film around a package entering said first section, a tunnel disposed alongside the frame to receive film-wrapped packages from said first section means in said tunnel arranged for effecting circulation of air heated by electrical heating elements for effecting shrinkage of the sealed film on a package which is introduced into the tunnel, and means for detecting a condition associable with the presence in said first section of the machine of a product wrapped in a film to be shrunk, the detecting means upon detection of said condition producing an actuation signal for effecting temporary actuation of the hot-air circulation means.

2. A machine as claimed in claim 1, wherein the detecting means comprises a sensor for detecting operation of the frame to said film sealing position.

3. A machine as claimed in claim 2, wherein the sensor sends said actuation signal on movement of the frame to said rest position after a sealing operation.

4. A machine as claimed in claim 2, wherein said sensor is operative also to send an actuation signal for heating the sealing blades on movement of the frame to said sealing position.

5. A machine as claimed in claim 4, wherein the sealing blades are disposed on a fixed abutment against which the movable frame rests on its movement to said sealing position to sandwich the film to be sealed between the abutment and said frame.

6. A machine as claimed in claim 2, wherein the sensor is a microswitch operated by the frame movement.

7. A machine as claimed in claim 1, wherein actuation of the circulation means takes place over a predetermined period of time by an actuation timer receiving said actuation signal.

8. A machine as claimed in claim 1, wherein the circulation means comprises a fan operating within the tunnel.

9. A machine as claimed in claim 1, wherein the electrical heating elements are held in a heat baghouse having a controlled passage to the inside of the tunnel, with opening means that are operated on actuation of the circulation means to enable the air set in motion in the tunnel to pass through the heat baghouse.

10. A machine as claimed in claim 9, wherein the heat baghouse has a lower opening communicating with the inside of the tunnel and with said controlled passage which is disposed above, the opening means comprising a shutter disposed on said passage and having a controlled-opening actuator.

11. A machine as claimed in claim 9, wherein the tunnel is passed through by a belt conveyor disposed to pass between an entry opening in the tunnel for introducing the products into the tunnel from said first section and an opposite opening for exit of the products from the tunnel.

12. A machine as claimed in claim 1, wherein the tunnel has at least one portion thereof made of a transparent material to enable sight of the film-shrinkage process taking place inside it.

* * * * *